US006503066B1

(12) United States Patent
Cantley

(10) Patent No.: US 6,503,066 B1
(45) Date of Patent: Jan. 7, 2003

(54) HYDROSTATIC PRESSURE TEST PUMP

(75) Inventor: George A. Cantley, Akron, OH (US)

(73) Assignee: Curtiss-Wright Flow Control Corporation, Lynhurst, NJ (US)

( * ) Notice: Subject to any disclaimer, the term of this patent is extended or adjusted under 35 U.S.C. 154(b) by 0 days.

(21) Appl. No.: 09/597,504

(22) Filed: Jun. 20, 2000

(51) Int. Cl.[7] ..... F04B 17/00
(52) U.S. Cl. ..... 417/403; 137/593
(58) Field of Search ..... 417/540, 212, 417/403, 401, 399, 38; 91/220, 337; 60/410, 413; 138/26, 30, 31; 137/565.18, 565.19, 565.34, 593

(56) References Cited

U.S. PATENT DOCUMENTS

| | | | | | |
|---|---|---|---|---|---|
| 1,552,696 | A | * | 9/1925 | Hartsock | 137/625.47 |
| 3,489,100 | A | | 1/1970 | Hill | |
| 3,788,781 | A | * | 1/1974 | McClocklin | 137/630.15 |
| 4,398,872 | A | | 8/1983 | Fleenor et al. | |
| 4,400,143 | A | | 8/1983 | O'Connor | |
| 4,430,049 | A | * | 2/1984 | Aiba | 417/540 |
| 4,441,862 | A | | 4/1984 | Vogel | |
| 4,736,674 | A | | 4/1988 | Stoll | |
| 4,759,263 | A | | 7/1988 | Lehle | |
| 4,789,312 | A | | 12/1988 | Moate et al. | |
| 5,433,240 | A | * | 7/1995 | Mueller | 137/99 |
| 5,445,505 | A | | 8/1995 | Hung | |
| 5,564,913 | A | * | 10/1996 | Lee | 417/397 |
| 5,626,467 | A | | 5/1997 | Cantley | |
| 6,305,421 | B1 | * | 10/2001 | Ahrweiler | 118/50 |

* cited by examiner

*Primary Examiner*—Charles G. Freay
(74) *Attorney, Agent, or Firm*—Pearne & Gordon LLP

(57) ABSTRACT

A pressure testing apparatus to bring, and maintain, pressure within a test vessel at a proof pressure. The apparatus includes an air motor and a fluid pump which is removably mountable to the air motor. The air motor drives the fluid pump and the pump piston which reciprocatively moves with the motor piston. A precision pressure adjustment unit is located on an outlet side of the fluid pump and includes a chamber and a piston manually adjustable to expel a fluid from the chamber to increase the pressure in the test vessel.

15 Claims, 6 Drawing Sheets

HYDROSTATIC PRESSURE TEST PUMP

BACKGROUND OF THE INVENTION

1. Field of the Invention

The present invention relates to fluid pump assemblies and, more particularly, to modular pump assemblies having a fluid pump A fluid activated motor for driving the fluid pump, and a precision adjustment unit for finely adjusting an output pressure.

2. Description of Related Art

Various fluid pump assemblies have been developed to pump fluid into a test vessel to test the integrity of a vessel by raising and sustaining the pressure therein to a proof pressure for a prescribed period of time. The fluid pump assembly developed has a piston assembly reciprocally mounted within a cylinder which is supplied with compressed air to pump fluid into the vessel being tested. The air is provided until the vessel reaches a predetermined pressure. However, existing fluid pump assemblies may not be sufficiently precise to accommodate stringent testing standards for pressure vessels, such as for example, the recent narrowing of a pressure range in which fire extinguishers are tested.

Accordingly, there is a need for an improved fluid driven pump which can bring a vessel within a narrow pressure range and maintain the pressure vessel within the pressure range for a prescribed time period.

SUMMARY OF THE INVENTION

The present invention provides a pressure testing apparatus and method for pressure testing a vessel. According to the present invention, the apparatus includes a pump and a precision adjustment unit connected at an outlet side of the pump. The precision adjustment unit includes a chamber and a piston assembly movably disposed in the chamber to vary the fluid volume of the chamber. Additionally, the precision adjustment unit can be connected to an intermediate position of a conduit which is connected to the outlet side of the pump. The piston assembly is comprised of an adjuster piston, an adjustment bar having a proximal end operably attached to the adjuster piston and a handle operably attached to the distal end of the adjustment bar. The adjuster piston can be moved by rotating the handle.

According to a first embodiment of the present invention, the apparatus includes an air-driven pump, a fluid pump and a precision adjustment unit. The air-driven pump is similar to the pump disclosed in U.S. Pat. No. 5,626,467 which is herein incorporated by reference. The air-driven pump includes an air motor, a motor cylinder within the air motor, a motor piston within the motor cylinder, and an air control system. The air control system supplies air from an air inlet to the motor cylinder alternately on each side of the motor piston while venting the motor cylinder on an opposite side of the motor piston to an air outlet to reciprocate the motor piston in the motor cylinder. The fluid pump is operably connected to the air motor and includes a pump cylinder and a pump piston within the pump cylinder. The pump piston is connected to the motor piston for reciprocable movement of the pump piston with the motor piston. The precision adjustment unit is connected at the fluid pump. The precision adjustment unit includes a chamber and a piston assembly to vary the fluid volume of the chamber.

According to an aspect of the present invention, the precision adjustment unit is connected at an outlet side of the fluid pump. The connection can be directly to the fluid pump, or indirectly through a conduit.

According to another aspect of the present invention, the precision adjustment unit includes a piston assembly movably disposed within the chamber. The piston assembly is further comprised of an adjustment bar having a handle so that the adjuster piston can be moved by rotating the handle. Further, the pressure test apparatus can include a manual air valve so that the air motor is supplied air only when the manual air valve is activated.

According to another embodiment of the present invention, the pressure testing apparatus includes an air-driven pump, a fluid pump and precision adjustment unit. The air-driven pump includes an air motor, a motor cylinder within the air motor, a motor piston within the motor cylinder, a shaft connected at its proximal end to the motor piston with the distal end of the shaft extending externally beyond the motor cylinder, and an air control system. The air control system supplies air from an air inlet to the motor cylinder alternately on each side of the motor piston while venting the motor cylinder on an opposite side of the motor piston to an air outlet to reciprocate the motor piston and the shaft in the motor cylinder. The fluid pump is operably connected to the air motor and includes a pump cylinder and a pump piston within the pump cylinder. The pump piston is connected to the motor piston for reciprocable movement of the pump piston with the motor piston. The precision adjustment unit is connected to the air motor and includes an adjustment bar having a first end removably connectable to the distal end of the shaft and a second end connected to a handle to allow manual adjustment of the position of the adjustment bar. Movement of the adjustment bar can impart movement to the shaft.

According to another aspect of the invention, the pressure testing apparatus further includes a bleeder valve to manually release air from the distal side of the cylinder, thereby producing a greater range of adjusting the pressure in the vessel. Still further, the pressure testing apparatus can be provided with an air valve connected to the air motor such that the air motor is supplied air only when the air valve is activated.

According to the method of the present invention, a precision adjustment unit is connected at a pump. A vessel is connected at an outlet side of the pump. The pump is operated until a predetermined pressure is reached within the vessel. Then the precision adjustment unit is operated until a proof pressure is reached within the vessel. The precision adjustment unit is periodically operated as necessary to maintain the vessel within the proof pressure range for a prescribed period of time. Additionally, the precision adjustment unit can be adjusted manually by turning a handle. Further, the precision adjustment unit can be connected at the outlet side of the pump. Still further, the precision adjustment unit can be integrally connected to the pump.

According to an aspect of the method, an air-driven pump having an air motor and a fluid pump, and a precision adjustment unit are provided. The precision adjustment unit is connected at the air-driven pump. A vessel is connected at an outlet of the fluid pump. Fluid is provided to an inlet of the fluid pump and air is provided to an air inlet of the air motor. When air is provided to the air motor, a piston within the air motor reciprocates until a predetermined pressure is reached within the vessel. Thereafter, the precision adjustment unit is adjusted until a proof pressure within the vessel is reached within a proof pressure range. The pressure within the vessel is maintained within the proof pressure range for a desired period of time by adjusting the precision adjustment unit as necessary.

According to another aspect of the method, a manual air valve is connected to the air inlet and provides air to reciprocate the motor piston until the predetermined pressure is reached within the vessel.

According to a further aspect of the method, the precision adjustment unit is connected at the outlet side of the fluid pump.

An alternative aspect of the method provides the precision adjustment unit integrally connected to the air motor. A valve can be connected to the air motor to release air from the distal side of the cylinder within the air motor. Operating the valve causes the motor piston to retract to allow sufficient piston travel so that proof pressure can be reached and maintained.

BRIEF DESCRIPTION OF THE DRAWINGS

These and further features of the present invention will be apparent with reference to the following description and drawings, wherein.

DETAILED DESCRIPTION OF THE EMBODIMENTS OF THE INVENTION

Figure 1:
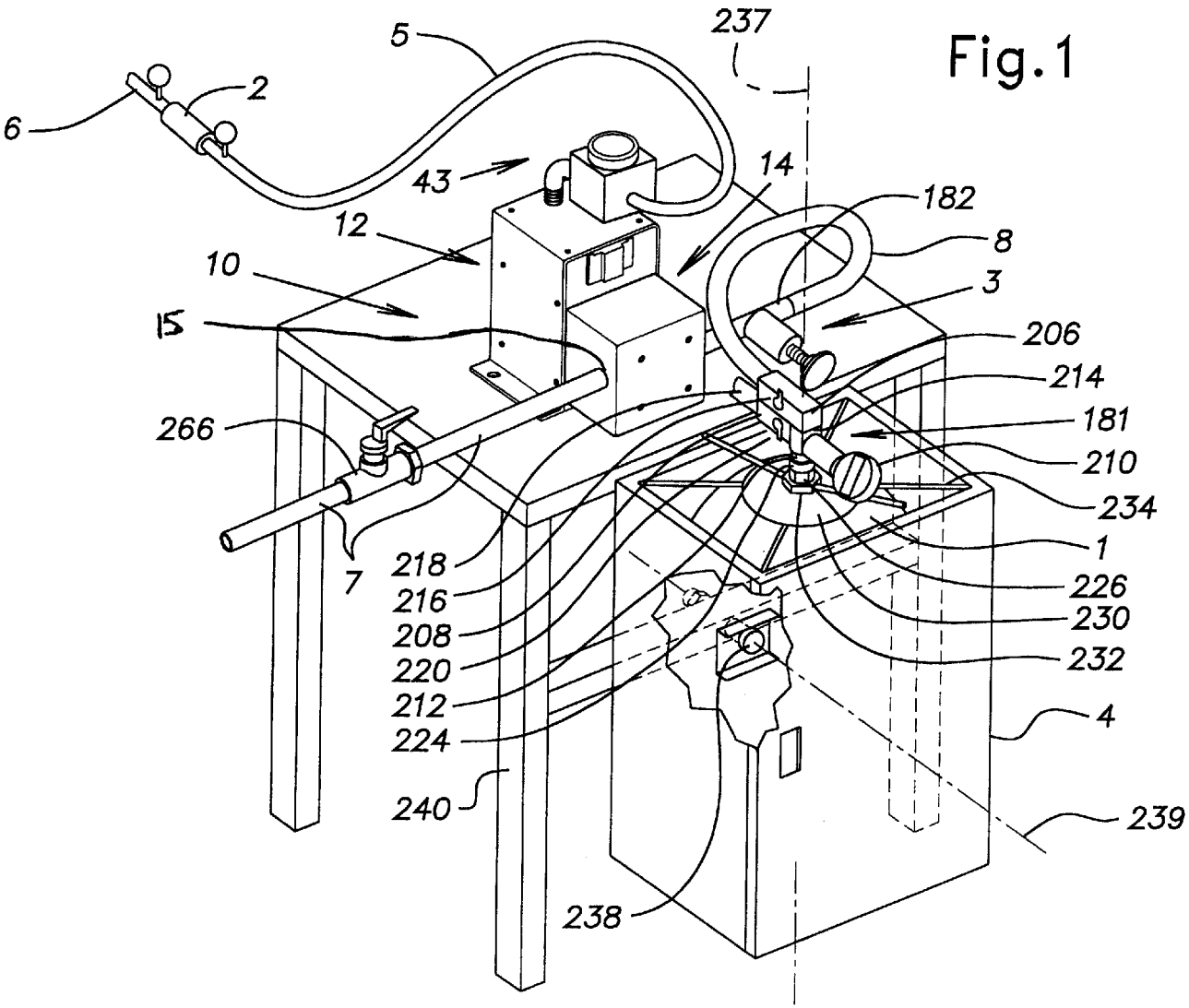
FIG. 1 is a perspective view of a pressure testing apparatus incorporating the pump according to the present invention.
Figure 4:
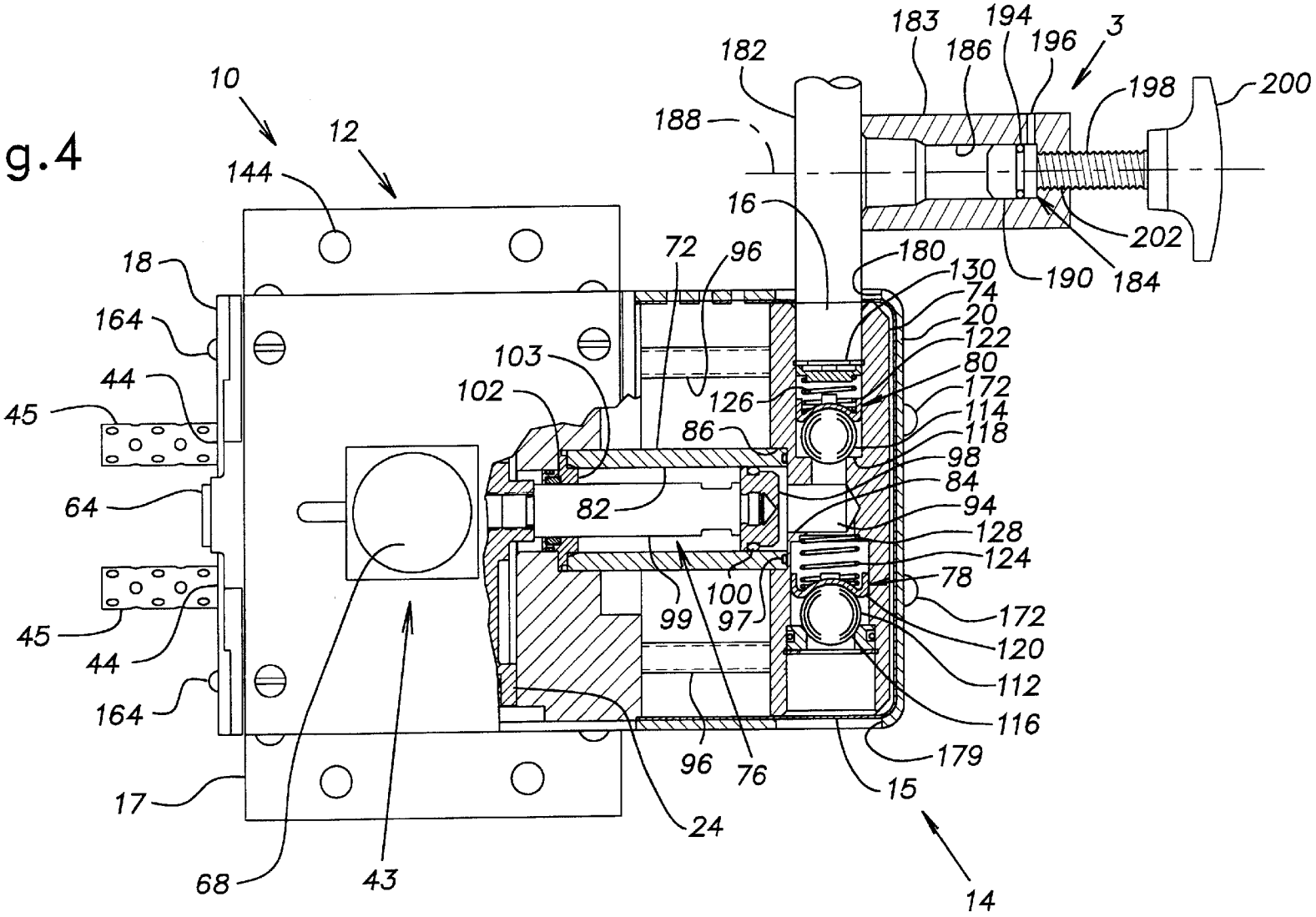
FIG. 4 is a plan view, in partial cross-section, of the pump of FIG. 1.

FIG. 1 illustrates a test apparatus for pressure testing a vessel 1. The test apparatus preferably includes an air-driven high pressure hydraulic pump 10, a regulator 2 or other flow control device such as, a needle valve, for example, a precision adjustment unit 3*a*, a safety cage 4 and the vessel 1. The pump 10 has an air-motor module 12 integrally connected to a fluid-pump module 14. Alternatively, other pumps can be used such as, for example, an electric or an internal combustion driven pump. An air inlet line 5 connects the air-motor module 12 to the regulator 2 which is supplied with air through an air supply line 6 from any suitable source such as, for example, an air compressor (not shown). The fluid-pump module 14 has a fluid inlet port 15 and a fluid outlet port 16 (FIG. 4). The inlet port 15 is supplied a fluid through a fluid inlet conduit 7 from any suitable source such as tap water. A fluid outlet conduit 8 connects the outlet port 16 to the vessel 1 and the precision adjustment unit 3*a* is connected to the fluid outlet conduit 8 between the outlet port 16 and the vessel 1.

Figure 2:
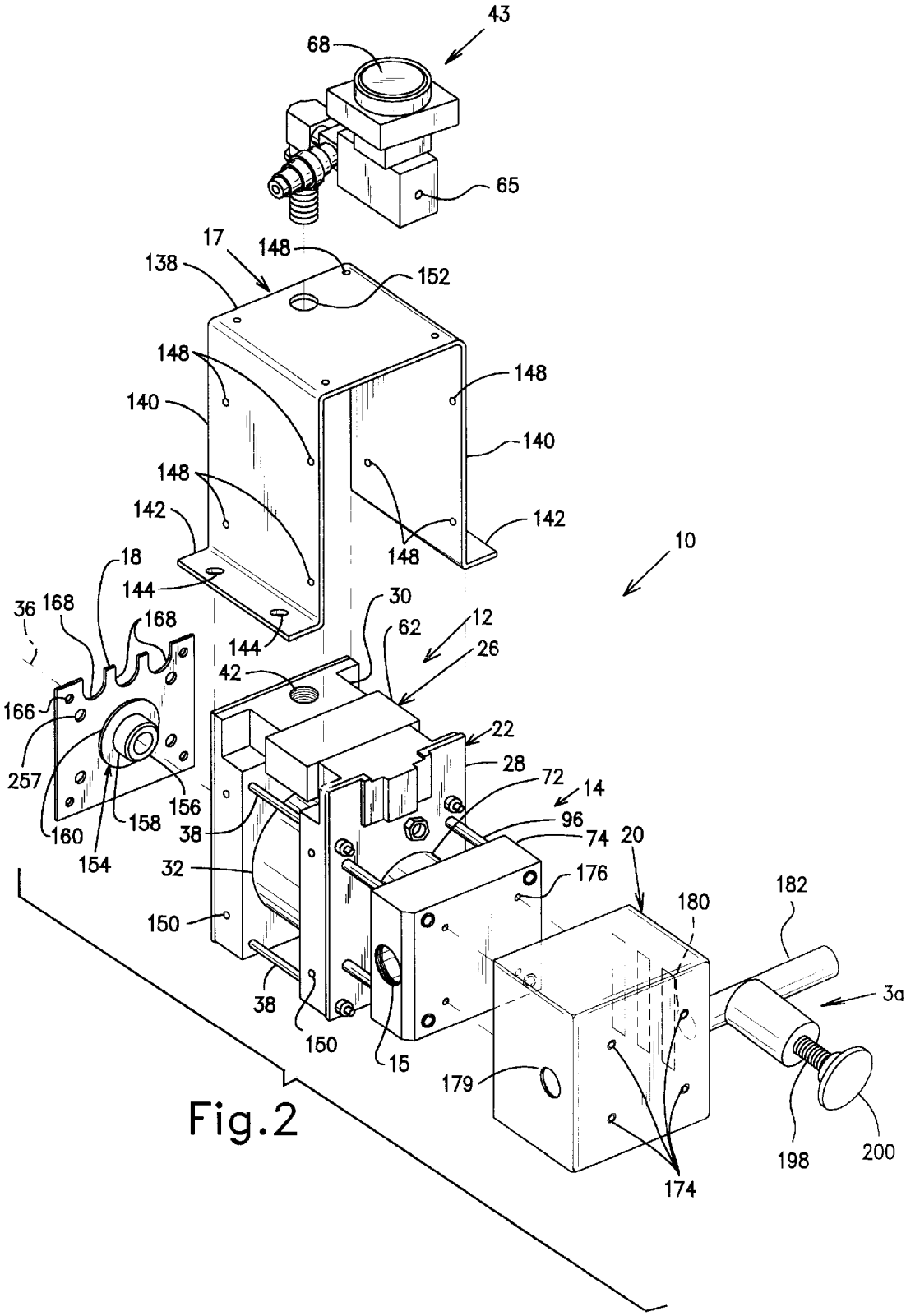
FIG. 2. is a partially exploded view of the pump of FIG. 1.

FIG. 2 illustrates the pump 10 which includes the air-motor module 12, the fluid-pump module 14, an air-motor enclosure 17, an end cover 18, and a fluid-pump enclosure 20. The air-motor enclosure 17 and the fluid-pump enclosure 20 provide shrouds for the pressurized cylinders of the air-motor module 12 and the fluid-pump module 14.

Figure 3:
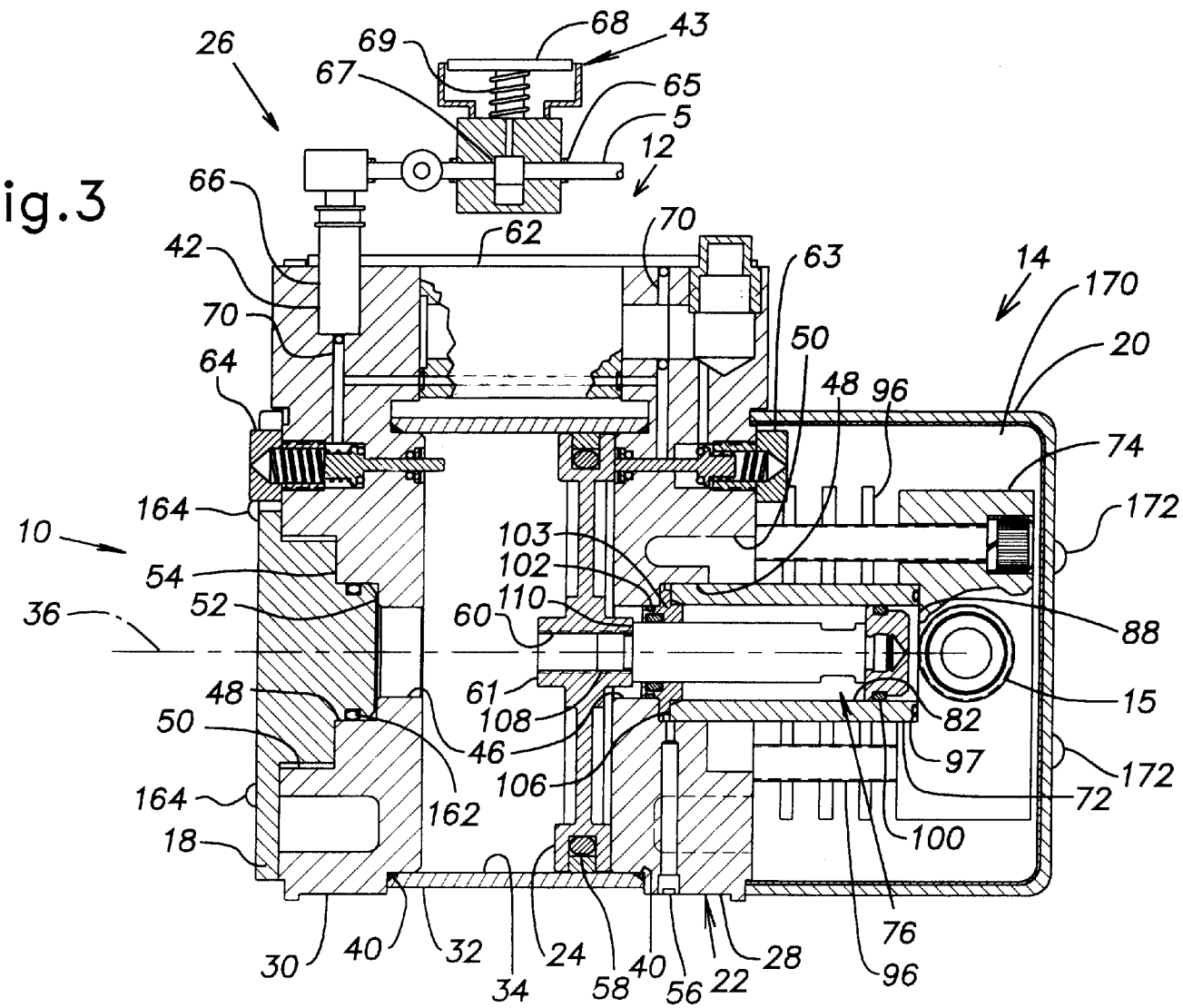
FIG. 3 is an elevational view, in cross-section, of the pump of FIG. 1.

As shown in FIGS. 2 and 3, the air-motor module 12 includes a cylinder assembly 22, a motor piston 24, and an air control system 26. The cylinder assembly 22 includes first and second bulkheads 28, 30 and a hollow tube 32 clamped therebetween to form a cylinder 34 having a horizontal axis 36. The bulkheads 28,30 are rectangularly-shaped and held together by threaded fasteners 38 which extend through the four comers of the bulkheads 28, 30. Suitable means 40 for sealing the hollow tube 32 to the first and second bulkheads 28, 30 are provided such as, for example, O-rings. The second bulkhead 30 has an air inlet 42 which opens at the top surface of the second bulkhead 30 and at least one air outlet 44 (FIG. 4) which opens at an outward end surface of the second bulkhead 30. The air inlet 42 is preferably suitably threaded for mating with a push-button air valve 43 through which compressed air is supplied. Alternately, the air inlet 42 can be directly connected to other flow control devices such as, for example, a variable pressure regulator (not shown). The air outlet 44 is preferably provided with a muffler 45. Alternatively, the first bulkhead 28 can be provided with the air inlet 42 which opens at a top surface of the first bulkhead 28 and at least one air outlet 44 which opens at an outward end surface of the first bulkhead 28.

Each of the bulkheads 28, 30 has an opening 46 extending therethrough and coaxial with the cylinder 34. First and second stepped counterbores 48, 50 having different diameters are formed on the outward end surfaces of the bulkheads 28, 30. The counterbores 48, 50 are coaxial with each other and the opening 46 and form first and second abutment surfaces 52, 54 which are substantially perpendicular to the horizontal axis 36 of the opening 46. The second counterbore 50 has a larger outer diameter than the first counterbore 48, and has a smaller depth than the first counterbore 48. Arranged in this manner the counterbores 48, 50 are generally stepped. As shown in FIG. 3, a vent passage hole 56 is provided which extends from a peripheral surface of the first counterbore 48 to a bottom surface of the first bulkhead 28.

The motor piston 24 is located within the cylinder 34 for horizontal movement therein between the bulkheads 28, 30. The motor piston 24 is provided with suitable means 58 for sealing the periphery of the motor piston 24 with the peripheral inner surface of the cylinder 34 such as, for example, an O-ring. An internally threaded central opening 60 is formed in the motor piston 24 which is substantially coaxial with the cylinder 34 and extends through the motor piston 24 to open on each side of the motor piston 24. An abutment surface 61 encircles each end of the opening 60 which is substantially perpendicular to the horizontal axis 36 of the cylinder 34.

The air control system 26 includes a push-button air valve 43, an air control valve 62, and first and second pilot valves 63,64. The push-button air valve 43 has an inlet 65, an outlet 66, a plug 67 and a push button 68. The air inlet line 5 connects the inlet 65 to the source of compressed air. The outlet 66 is suitably threaded for mating with the air inlet 42. The plug 67 provides fluid communication between the inlet 65 and outlet 66 when the plug 67 is open and seals off fluid communication when the plug 67 is closed. The push button 68 controls the position of the plug 67. When the push button 68 is depressed, the plug 67 is open and a spring 69 returns the plug 67 to a closed position when the push button 68 is released.

The air control valve 62 is mounted between the first and second bulkheads 28, 30 above the cylinder 34. The pilot valves 63, 64 extend through the first and second bulkheads 28, 30 near the top of the cylinder 34 and into the ends of the cylinder 34. Air passages 70 are formed in the first and second bulkheads 28, 30 to provide suitable fluid communication among the air inlet 42, the air control valve 62, the pilot valves 63, 64, the cylinder 34, and the air outlet 44.

The air control valve 62 supplies compressed air from the air inlet 42 to the cylinder 34 on a first side of the motor piston 24 while the cylinder 34 on the second side of the motor piston 24 is being vented to the air outlet 44 to cause the motor piston 24 to horizontally move toward the second pilot valve 64. The motor piston 24 actuates the second pilot valve 64 near the end of its stroke of movement to cause the air control valve 62 to supply air to the cylinder 34 on the second side of the motor piston 24 while venting the cylinder 34 on the first side of the motor piston 24 to cause the motor piston 24 to horizontally move in the opposite direction toward the first pilot valve 63. The motor piston 24 actuates the first pilot valve 63 near the end of its stroke of movement which again reverses the direction of the motor piston 24. In this manner, the motor piston 24 horizontally reciprocates back and forth within the cylinder 34.

As shown in FIGS. 2, 3 and 4, the fluid-pump module 14 includes a cylinder block 72, an end block 74, a pump piston 76, and inlet and outlet check valves 78, 80. The cylinder block 72 is generally cylindrically shaped and forms a longitudinally extending pump cylinder 82 having the horizontal axis 36. The cylinder block 72 has an outer diameter sized to cooperate with the first counterbore 48 in the first bulkhead 28 of the air-motor module 12. The cylinder block 72 could have other cross-sectional shapes such as, for example, rectangular or triangular, however, the counterbores 48, 50 in the bulkheads 28, 30 would require similar shapes for cooperating with and receiving the cylinder block 72.

An inward end of the end block 74 is provided with a horizontally extending blind hole 84 and a counterbore 86 substantially coaxial with the blind hole 84 and having an outer diameter sized for receiving the outer diameter of the cylinder block 72. The counterbore 86 forms an inward facing abutment surface 88 which is substantially perpendicular to the axis 36 of the blind hole 84. Fluid inlet and outlet ports 15, 16 are formed in the end block 74 which open at the opposite side surfaces of the end block 74 and extend to the blind hole 84. The fluid inlet port 15 is of a larger diameter than the fluid outlet port 16 to facilitate the flow of fluids. The fluid inlet and outlet ports 15, 16 are aligned with one another, substantially coaxial, and diametrically opposed across the pumping chamber 94 formed by the blind hole 84 and the pump cylinder 82. An outer portion of the fluid inlet and outlet ports 15, 16 is suitably threaded for connecting fluid input and output conduits 7, 8.

The end block 74 is rectangularly-shaped and attached to the first bulkhead 28 with threaded fasteners 96 longitudinally extending through the four corners of the end block 74. The cylinder block 72 is within the counterbores 48, 86 of the first bulkhead 28 and the end block 74 and is thereby clamped therebetween with the pump cylinder 82 substantially coaxial with the motor cylinder 34. Suitable means 97 for sealing the cylinder block 72 to the end block 74 are provided such as, for example, an O-ring.

The pump piston 76 is located within the pump cylinder 82 for horizontal movement therein. The pump piston 76 has a body portion 98 carried by an integrally connected shaft portion 99. The body portion 98 and the shaft portion 99 have an outer diameter smaller than the outer diameter of the motor piston 24. A high-pressure sealing member 100 (suitable for withstanding pressures of the fluid in the pumping chamber 94) and a low-pressure sealing member 102 (relative to the high pressure sealing member 100 and suitable for withstanding pressures of the air in the pump cylinder 82 of the air-motor module 12) are provided to seal the periphery of the pump piston 76 with the peripheral inner surface of the pump cylinder 82. The body portion 98 carries the high pressure sealing member 100 which engages the periphery of the pump cylinder 82 at a position outward of the vent passage hole 56 in the first bulkhead 28 of the air-motor module 12. A support member 103 is provided within the first counterbore 48 of the first bulkhead 28 to close the cylinder 82 and to support the shaft portion 99. The support member 103 is provided with the low pressure seal 102 which engages the shaft portion 99. The low pressure sealing member 102 is provided at a position inward of the vent passage hole 56 in the first bulkhead 28 of the air motor module 12. The support member 103 has a vent passage 106 which provides fluid communication between the vent passage hole 56 and a space intermediate to the high and low pressure sealing members 100, 102. The low pressure sealing member 102 acts as a back-up to the high pressure sealing member 100 for controlled venting, through the vent passage hole 56, of any fluid leaking past the high pressure sealing member 100 and thereby preventing misting of air in the air-motor module 12 by leaking fluid from the fluid-pump module 14. The venting of the leaking fluid through the vent passage hole 56 also provides ready detection of the leakage past the high pressure sealing member 100 and creates an economical separated pump.

The inward end of the pump piston 76 has an externally threaded stem 108 which is substantially coaxial with the motor cylinder 34 and is sized for removably mating with the threaded central opening 60 of the motor piston 24. An inward facing abutment surface 110 is provided on an outward end of the stem 108 and is substantially perpendicular to the horizontal axis 36 of the cylinder 34. The abutment surface 110 is sized and positioned to engage the outward facing abutment surface 61 of the motor piston 24 when the stem 108 is fully engaged in the threaded central opening 60. With the pump piston 76 coupled to the motor piston 24, the pump piston 76 horizontally moves with the reciprocating motor piston 24.

The inlet check valve 78 is located in the fluid inlet port 15 and the outlet check valve 80 is located in the fluid outlet port 16. Each check valve 78, 80 preferably includes a ball 112, 114 forming the movable valve element, a wear resistant seat 116, 118 for the ball 112, 114, a ball retainer guide 120, 122 which guides the ball relative to its seat and prevents the ball from seating on the inlet side of the fluid inlet port 15 or the outlet side of the fluid outlet port 16, a spring member 124, 126 which urges the ball 112, 114 to the seat 116, 118, and a base member 128, 130 which holds the spring member 124, 126 in position. The guides 120, 122 each have cut away portions in their sidewalls to facilitate passage of the fluid. The balls 112, 114 are seated and unseated by negative and positive pressure generated by the pump piston 76 in the pumping chamber 94.

As the pump piston 76 is moved inwardly on its suction stroke by the motor piston 24, the outlet ball 114 will seat on its seat 118 and the inlet ball 112 will be forced inwardly off its seat 116 and fluid will be sucked from a supply through fluid inlet port 15 and the inlet check valve 78 to the pumping chamber 94. The outlet check valve 80 prevents return of the fluid through the fluid outlet port 16. When the pump piston 76 reverses its direction and is moved outwardly on its pressure stroke by the motor piston 24, the inlet ball 112 is seated on its seat 116 and the outlet ball 114 is forced outwardly off its seat 118 by fluid being pushed forward under pressure by the pump piston 76, and the fluid is delivered under pressure through the fluid outlet port 16 to a point of use. The inlet check valve 78 prevents passage of the fluid out the fluid inlet port 15. As the pump piston 76 continues to reciprocate, fluid is pulled into and pushed out of the pumping chamber 94 and essentially passes diametrically through the pumping chamber 94 from the fluid inlet port 15 to the fluid outlet port 16.

The modular design of the pump 10 enables variously sized fluid-pump modules 14 to be interchangeably mounted to the same air-motor module 12. The pump piston 76 is removably coupled to the motor piston 24, and the fluid-pump module 14 is removably coupled to the air-motor module 12 so that a variety of fluid-pump modules 14 can be easily used with a common air-motor module 12. A large size range of fluid-pump modules 14 can be utilized with the same air-motor module 12 because the bulkheads 28, 30 are provided with the concentric counterbores 48, 50 which receive cylinder blocks 72 having different outer diameters. The different outer diameters enable the efficient use of pump pistons 76 having different drive areas. By providing pump pistons 76 with different drive areas, a number of different outlet pressures and rates of flow can be provided. Specific examples of these alternate configurations utilizing fluid-pump modules with pump pistons having different drive areas are described in U.S. Pat. No. 5,626,467 herein incorporated by reference.

The modular design of the pump 10 also enables a fluid-pump module to be mounted to the other end of the air-motor module 12. The motor piston 24 is adapted to have a pump piston 76 removably coupled on each end and the second bulkhead 30 is adapted for removably receiving the other fluid-pump module 14 in the same manner as described above for the first bulkhead 28. The reciprocation of the motor piston 24 causes the two pump modules 14 to be operated alternately, i.e. the motor piston 24 drives the pump piston 76 of one fluid-pump module 14 on a forward pressure producing stroke and drives the pump piston 76 of the other fluid-pump module on a rearward suction producing stroke, and then reverses to drive the first pump piston 76 on a suction stroke and the second piston 76 on a pressure stroke. Double ended pumping allows an increased flow rate and/or proportional mixing of two fluids by using fluid-pump modules 14 having different displacement ratios.

As shown in FIG. 2, the air-motor enclosure 17 is generally inverted-U-shaped having a top portion 138 and two side portions 140 perpendicularly extending downward from outer sides of the top portion 138. Perpendicularly extending outward from the bottom edge of each side portion 140 is a mounting flange 142 provided with suitable openings 144 for mounting fasteners. Preferably, the air-motor enclosure 17 is formed from a single sheet of material. The air-motor enclosure 17 is sized to longitudinally extend from the first bulkhead 28 to the second bulkhead 30 and enclose the top and sides of the air-motor module 12. The air-motor enclosure 17 is attached to the air-motor module 12 by threaded fasteners which extend through openings 148 provided in the top and side portions 138, 140 and mate with threaded holes 150 provided in the first and second bulkheads 28, 30. An opening 152 is provided in the top portion 140 to provide adequate clearance for the air inlet 42.

As shown in FIGS. 2 and 3, the air-motor end cover 18 is generally planar for mating with and covering the outer end of the second bulkhead 30 and has a plug 154 extending from the inner side for sealing the opening 46 in the second bulkhead 30. The end cover 18 only needs to seal the opening 46 in the second bulkhead 30 when there is not a fluid-pump module 14 attached thereto. The plug 154 has first, second, and third cylindrical portions 156, 158, 160 which are substantially coaxial and have increasing diameters. The first cylindrical portion 156 has an outer diameter sized to extend into the opening 46 of the second bulkhead 30. The second cylindrical portion 154 has an outer diameter sized to extend within the first counterbore 48 of the second bulkhead 30 and is substantially equal to the outer diameter of the cylinder block 72 of the fluid-pump module 14. The third cylindrical portion 160 has an outer diameter sized to extend within the second counterbore 50 of the second bulkhead 30. If desired, suitable means 162 for sealing the plug 154 with the second bulkhead 30 such as, for example, an O-ring can be provided. The end cover 18 is attached to the air-motor module 12 by threaded fasteners 164 which extend through openings 166 provided in the end cover 18 and mate with threaded holes (not shown) provided in the outward end of the second bulkhead 30. A notch 168 is provided in the end cover 18 to provide adequate clearance for the second pilot valve 64 and the mufflers 45.

As shown in FIGS. 2 and 3, the fluid-pump enclosure 20 is generally a hollow cube having an inward facing open end. The open end of the fluid-pump enclosure 20 engages the outer end of the first bulkhead 28 of the air-motor module 12 to form an enclosed hollow interior space 170. The fluid-pump module 14 is located within the interior space and is fully surrounded by the fluid-pump enclosure 20 and the first bulkhead 28. The fluid-pump enclosure 20 is attached by threaded fasteners 172 which extend through openings 174 provided in the outward end of the fluid-pump enclosure 20 and mate with threaded holes 176 provided in the outer end of the end block 74 of the fluid-pump module 14. Openings 179, 180 in the lateral sides of the fluid-pump enclosure 20 provide adequate clearance for the fluid inlet and outlet ports 15, 16.

The precision adjustment unit 3*a* is connected to an intermediate portion of the fluid outlet conduit 8 between the fluid outlet port 16 and a test apparatus 181. The intermediate portion of the fluid outlet conduit 8 is provided with an externally threaded tee 182 for connection to the precision adjustment unit 3*a*. As shown in FIG. 4 the precision adjustment unit 3*a* includes a cylinder block 183 and an adjuster piston 184. The cylinder block 183 is generally cylindrically shaped and defines a longitudinally extending cylinder 186 having a horizontal axis 188. The peripheral inner surface of the cylinder 186 is sized and threaded for mating to the externally threaded tee 182. The adjuster piston 184 is located within the cylinder 186 for horizontal movement therein. The adjuster piston 184 has a body portion 190 carried by an integrally connected adjustment bar 198. Means 194 for sealing the periphery of the adjuster piston 184 with the inner surface of the cylinder 186, such as an O-ring, is provided. The body portion 190 carries the sealing means 194 which engages the peripheral inner surface of the cylinder 186 at a position inward of a vent hole 196 provided in the cylinder 186. Fluids leaking past the sealing means 194, are vented through the vent hole 196, thereby providing ready detection of leakage past the sealing means 194.

The adjustment bar 198 is substantially coaxial with the cylinder 186 and externally threaded adjustment bar 198. The adjustment bar 198 extends outwardly from the interior of the cylinder 186 beyond an outer surface of the cylinder block 183 through a threaded opening 202 in the cylinder block 183. The threaded adjustment bar 198 and the threaded opening 202 communicate to allow the adjuster piston 184 to advance into the cylinder 186, or retract, when the adjustment bar 198 is rotated. An adjustment handle 200 is provided on the outer end of the adjustment bar 198 to provide a mechanical advantage to facilitate easy rotation of the adjustment bar 198.

As shown in FIG. 1, the test apparatus 181 includes an inlet valve 206, an outlet valve 208, a pressure gauge 210, a hollow threaded stem 212 and a central chamber 214. The central chamber 214 is formed to provided suitable fluid communication among the inlet valve 206, the outlet valve 208, the pressure gauge 210 and the threaded stem 212.

The inlet valve 206 has an inlet end connected to the fluid outlet conduit 8 and an outlet end connected to the central chamber 214. A gate (not shown) located within the inlet valve 206 controls fluid communication between the fluid outlet conduit 8 and the central chamber 214. A rod (not shown) joins the gate to a knob 216. The gate is rotated between an open and a closed position by manually rotating the knob 216.

The outlet valve 208 has an inlet end connected to the central chamber 214 and an outlet end connected to a drain conduit 218. A gate (not shown) located within the outlet valve 208 controls fluid communication between the central chamber 214 and the drain conduit 218. A rod (not shown) joins the gate to a knob 220. The gate is rotated between an open and a closed position by manually rotating the knob 220.

The pressure gauge 210 is connected to the central chamber 214. The pressure gauge 210 is any suitable pressure gauge.

The hollow threaded stem 212 has an upper end connected to the central chamber 214 and a lower end. A quick release coupler 224 joins the lower end of the stem to a head assembly 222.

The head assembly 222 includes a threaded adapter 226, a gasket (not shown), a head 230 and a spin clamp 232. The adapter 226 has a proximal end securely attached to the coupler 224 and a distal end securely threaded into a threaded opening in the top of the vessel 1. The gasket is disposed around the adapter 226 to prevent escape of the fluid. The head 230 is disposed around the adapter 226 above the gasket. A spin clamp 232 is rotatably connected to the adapter 226 above the head 230. The spin clamp 232 is threaded to allow advancement along the adapter 226 when rotated. The spin clamp 232 can be advanced to firmly engage the head 230 thereby tightening the head 230 against the vessel 1 and securing the gasket there between. The head 230 is provided with radially extending arms 234. The arms 234 contact a safety cage 4 to restrict the vessel 1 from moving along a vertical axis 237.

The vessel 1 is supported by the safety cage 4. The safety cage 4 is preferably generally cubed shaped having an upward facing open end. The safety cage 4 is sized to accommodate the vessel 1 without excessive play. A side of the safety cage 4 can be provided with a door to provide access for inserting the vessel 1 into the safety cage 4. The safety cage 4 is rotatably attached to an outer end of a rod 238 having a horizontal axis 239. The inner end of the rod 238 is attached to any suitable structure 240 such as for example, a table or stand. The structure 240 is sized to support and suspend the safety cage 4 above a floor so that the vessel 1 can be rotated at least 180° about the horizontal axis 239.

Figure 5:
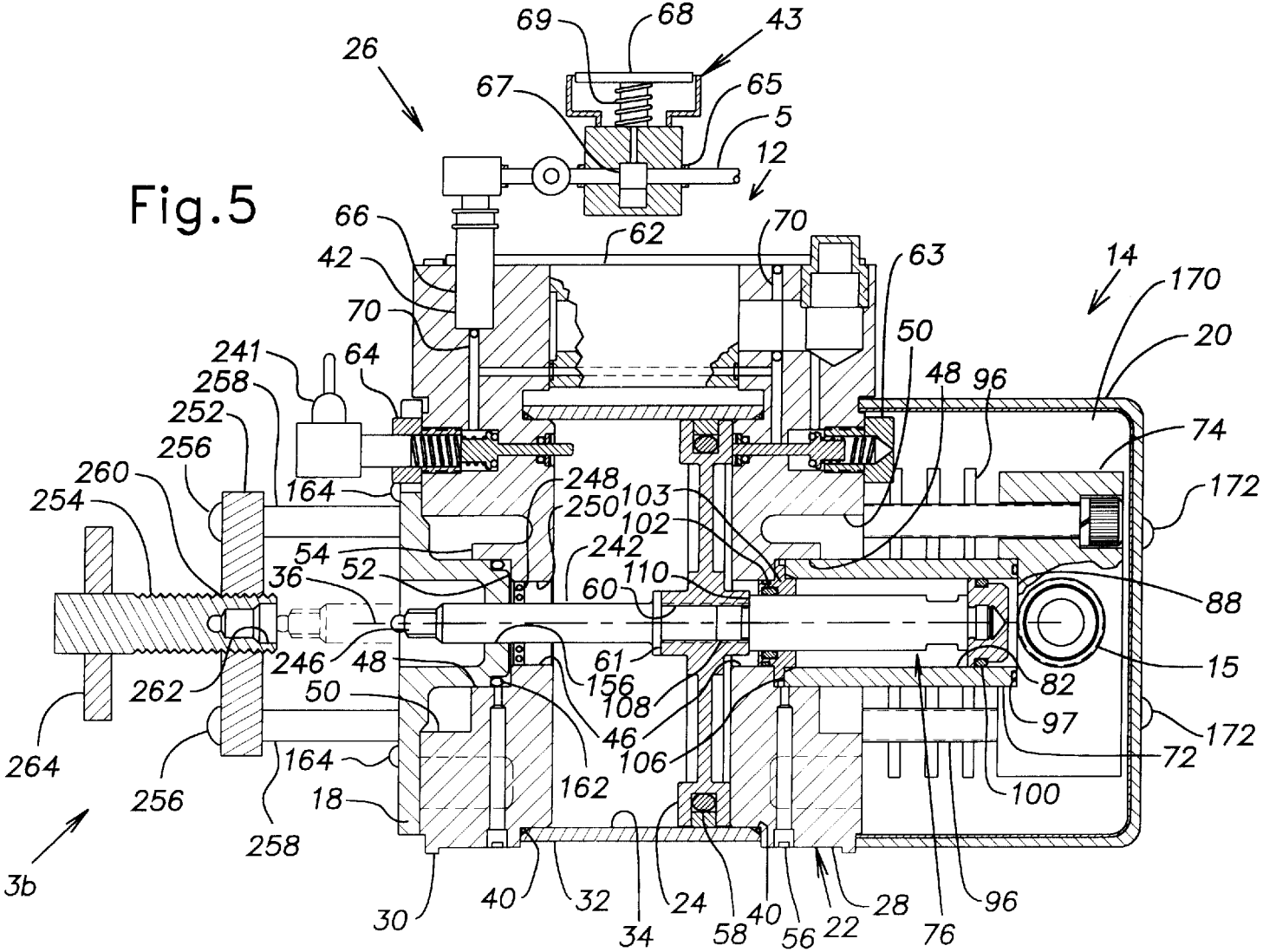
FIG. 5 is an elevational view, in cross-section, of another embodiment of the pump similar to FIG. 3, but with an integral precision manual adjustment unit.
Figure 6:
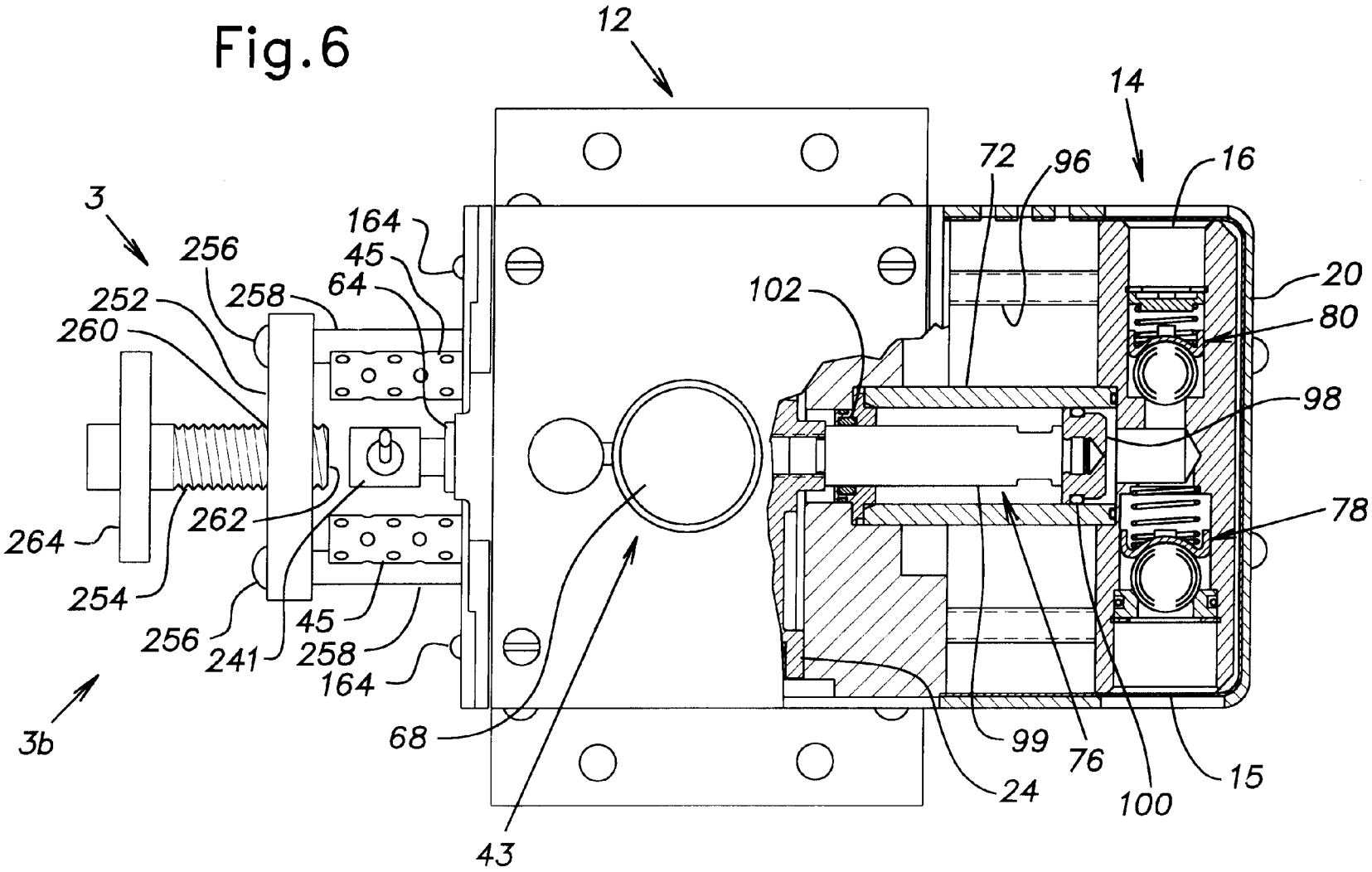
FIG. 6 is a plan view, in partial cross-section, of the pump of FIG. 5.
Figure 2:
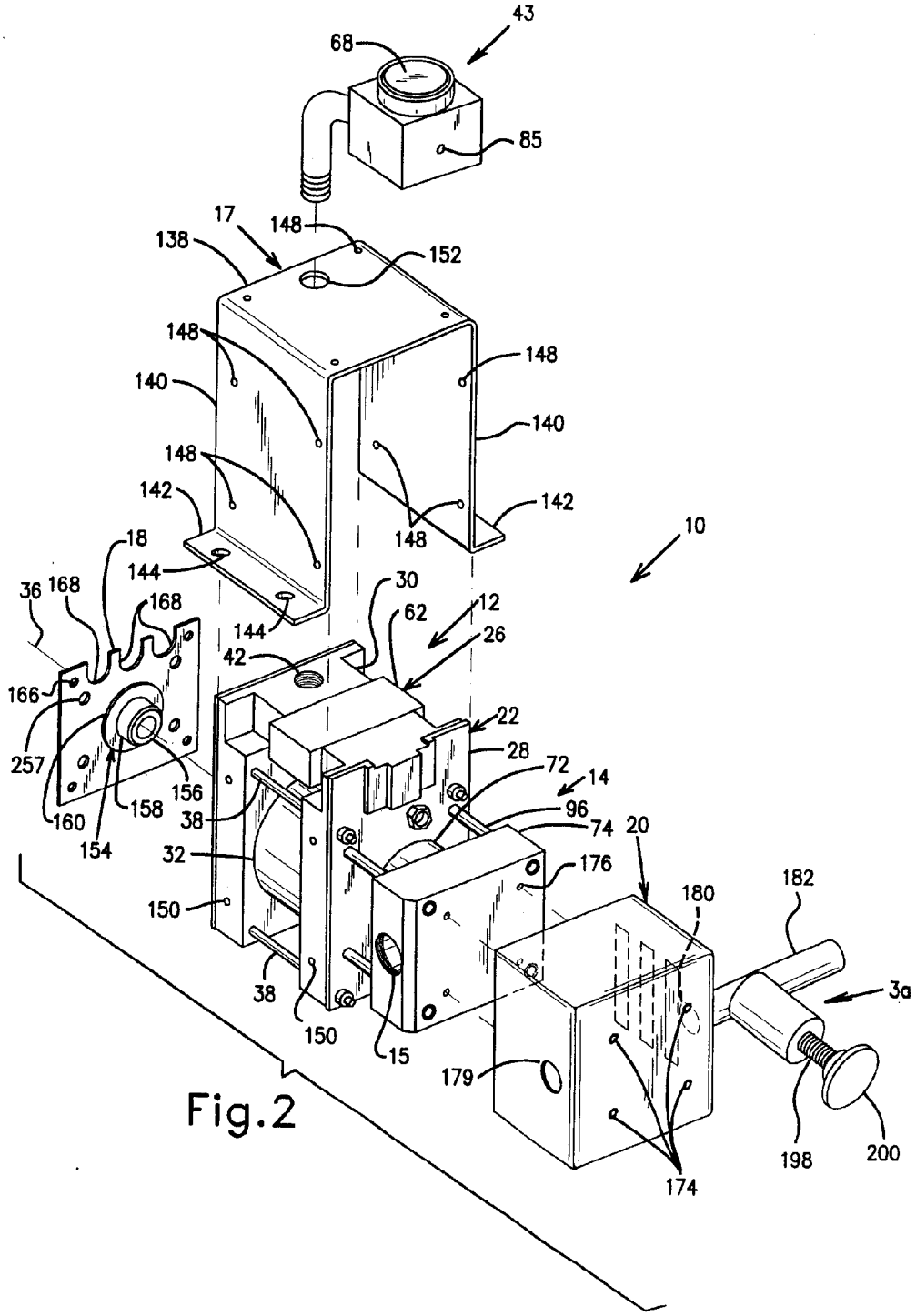
Figure 3:
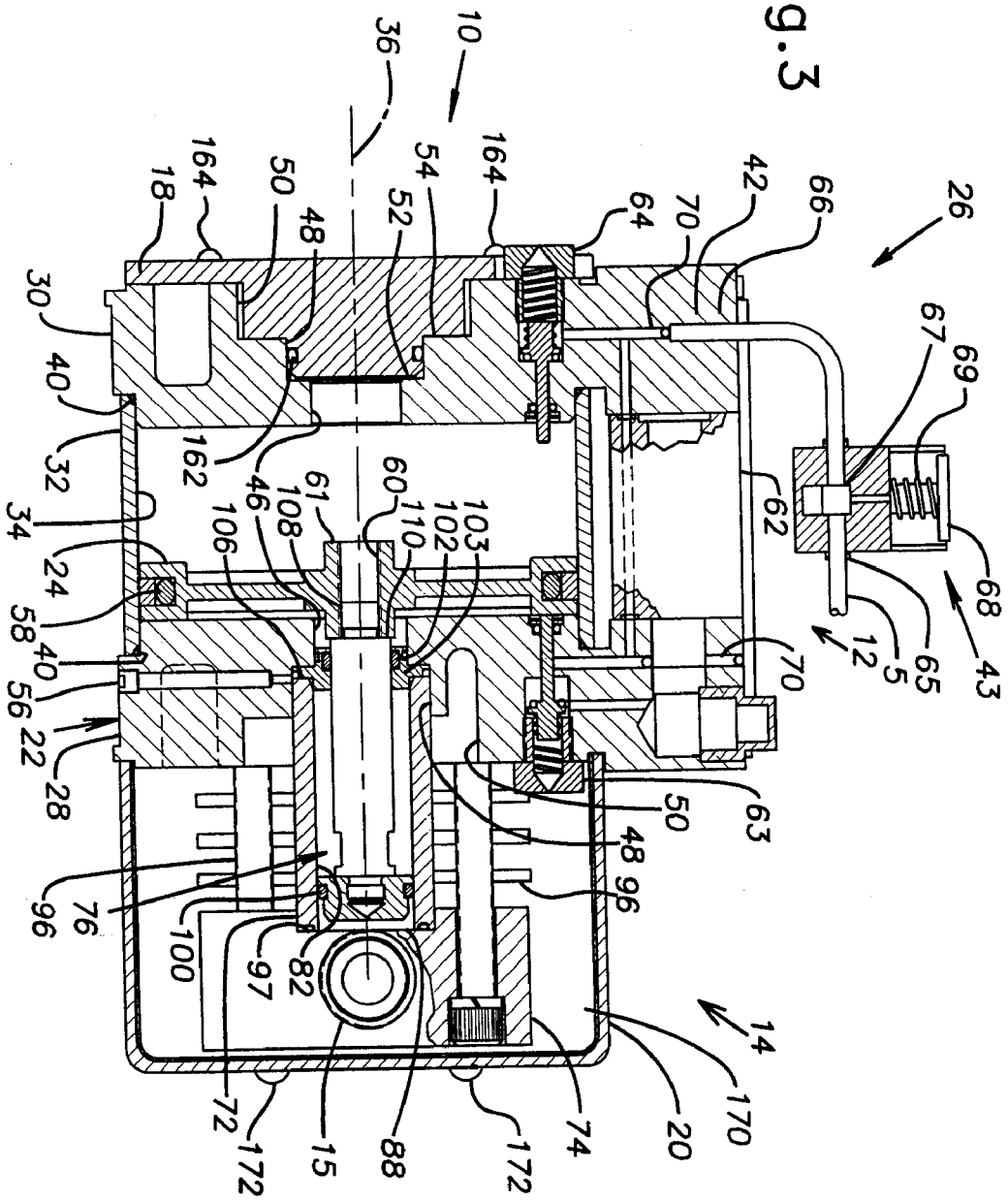
Figure 5:
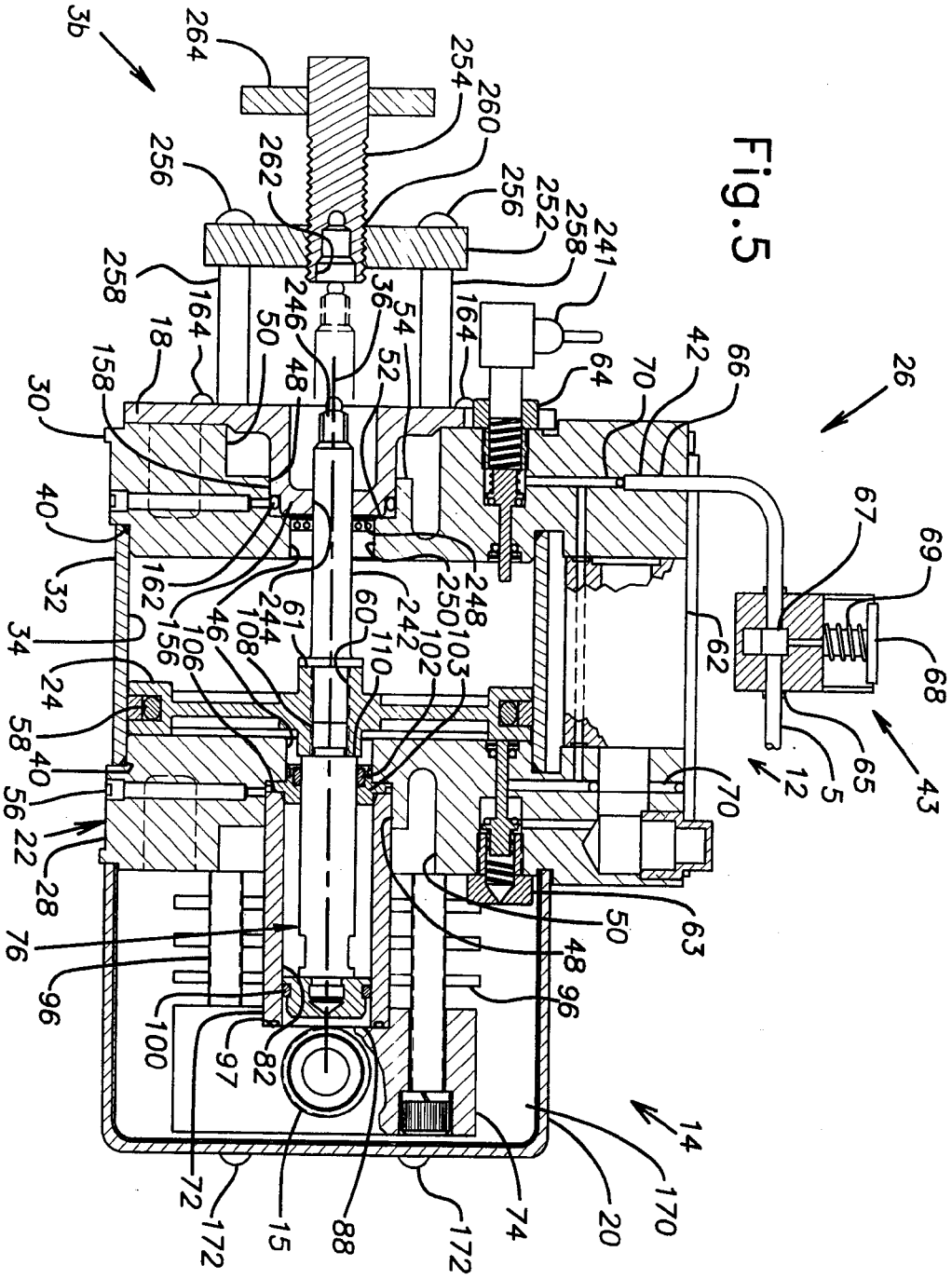
Figure 6:
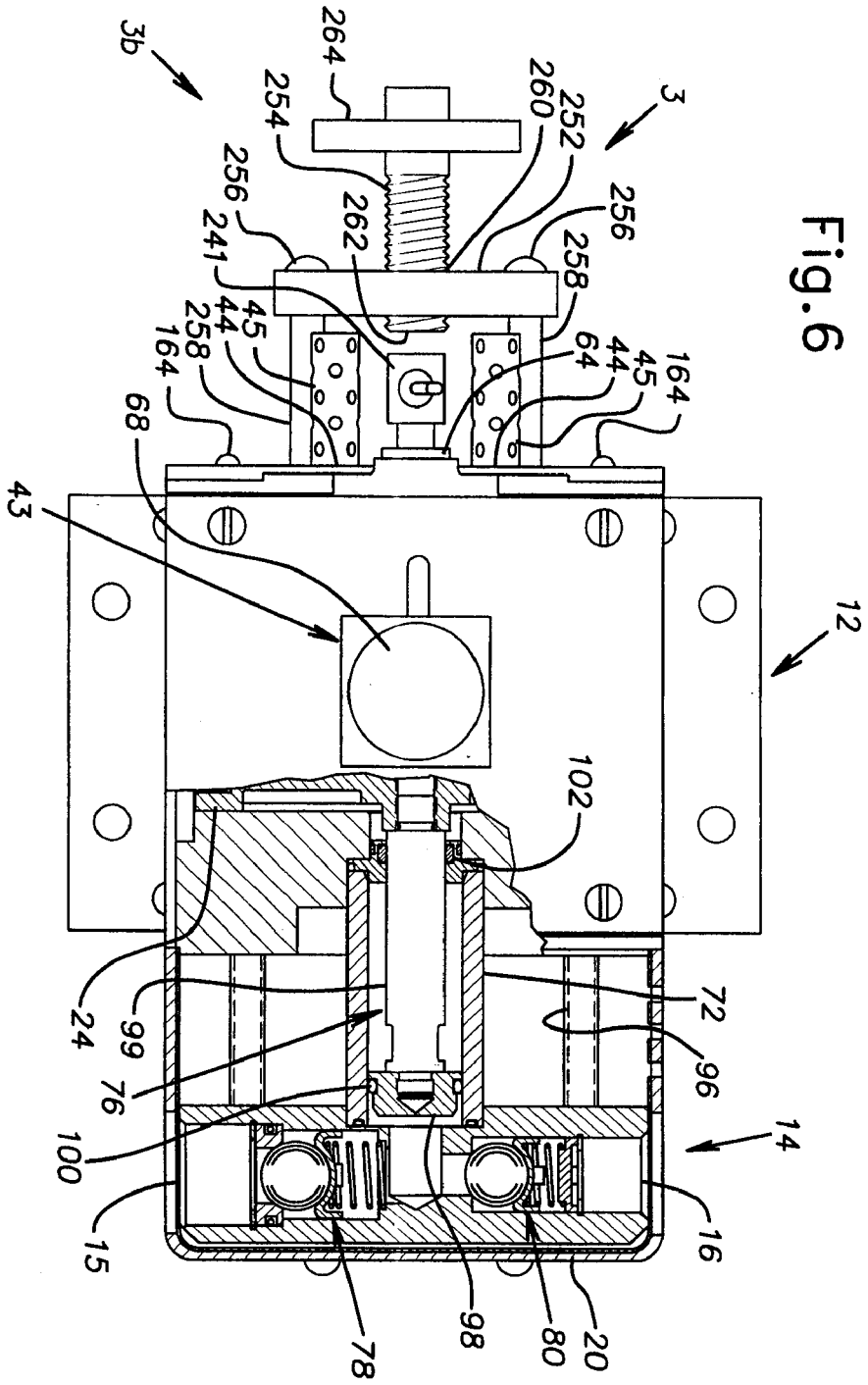

FIGS. 5 and 6 illustrate a different embodiment of the pump 10 and a pressure adjustment unit 3*b* for pressure testing a vessel 1. Like reference numbers are used for like structure previously described. The pump 10 is similar as previously described, except that the pump 10 according to this embodiment is provided with a bleeder valve 241.

A shaft 242 is connected to the second side of the motor piston 24 and is substantially coaxial with the motor cylinder 34. The shaft 242 has an externally threaded proximal end sized for removably mating with the threaded central opening 60 of the motor piston 24. A distal end of the shaft 242 extends through an opening 244 of the first and second cylindrical portions 156, 158 of the plug 154. The shaft 242 has a length such that the distal end of the shaft 242 is external the air-motor 12 for all positions of the motor piston 24. The proximal end of the shaft 242 is provided with a head 246 rotatably attached to the shaft 242 about the horizontal axis 36. Sealing means 248 for sealing the periphery of the shaft 242 with the surface of the opening 244 are provided such as, for example, an O-ring. A support member 250 can be provided within the opening 244 to close the opening 244 and support the shaft 242. The support member 250 is provided with the sealing means 248 which engages the shaft 242.

The precision adjustment unit 3*b* according to this embodiment of the present invention includes a support wall 252 and a threaded member 254. The support wall 252 is rectangularly-shaped and fixedly held, at a distance, to the end cover 18 by threaded fasteners 256 which extend through the four comers of the support wall 252 into openings 257 provided in the end cover 18. A sleeve 258 is provided around each of the threaded fasteners 256 and spaces the support wall 252 from the end cover 18. The support wall 252 has a threaded opening 260 through which the threaded member 254 travels. The threaded member 254 is substantially coaxial with the shaft 242 and extends through the threaded opening 260 for horizontal movement therethrough. The threaded member 254 cooperates with the threaded opening 260 to allow the threaded member 254 to advance, or retract, when the threaded member 254 is rotated.

The threaded member 254 has a proximal and a distal end. The proximal end includes a socket 262. The socket 262 is a multi-sided hollow structure which forms a cavity having an inward facing open end. The cavity is sized and shaped to removably engage the head 246. For example, the head 246 and cavity can be hexagonal. The distal end of the threaded member 254 is provided with an adjustment knob 264. The adjustment knob 264 provides a mechanical advantage to facilitate easy rotation of the threaded member 254. The threaded member 254 is located away from the shaft 242 while the pump 10 is in operation. To finely adjust the pressure in the vessel 1, the threaded member 254 is advanced such that the socket 262 engages the head 246 of the shaft 242 and furthers the piston 24 towards the first side of the motor cylinder 34.

The method for pressure testing a vessel 1 includes placing the vessel 1 in the safety cage 4, connecting the test apparatus 181 to the vessel 1, supplying fluid and air to the hydraulic pump 10, applying and maintaining pressure, precisely adjusting the pressure, and removing the vessel 1 from test apparatus 181. Note that alternative pumps such as, for example, electric and engine driven pumps can be used with fluid and/or air supplied in a known manner.

The vessel 1 is set into the safety cage 4. The adapter 226 is securely threaded into the threaded opening at the top of the vessel 1. The gasket is disposed around the adapter 226 to prevent escape of the fluid. If needed, the head 230 can be placed on top of the gasket. The head 230 can be tightened to the vessel 1 by rotating the spin clamp 232 to advance the spin clamp 232 along the adapter 226 towards the vessel 1. The sides of the safety cage 4 and the radially extending arms 234 of the head 230 hold the vessel 1 in a position so that the vessel 1 remains in position when the safety cage 4 is rotated about the horizontal axis 239. The coupler 224 is securely attached to the adapter 226.

As shown in FIG. 1, the fluid-pump 10 is supplied with fluid delivered through the fluid inlet conduit 7 from the fluid supply source. The fluid inlet conduit 7 is provided with a suitable valve 266 such as, for example, a ball valve. Initially, the valve 266 is in a closed position therein restricting fluid from entering the fluid pump module 14. Air is supplied to the air-motor module 12 through the air inlet line 5 from a regulator 2. The regulator 2 is set to a desired pressure.

The vessel 1 is filled with the fluid being used to pressure test the vessel 1. The valve 266, the inlet valve 206 and the outlet valve 208 are opened. The fluid supply is turned-on. The vessel 1 is filled with the fluid when a steady stream of the fluid appears exiting the drain conduit 218. The outlet valve 208 is then closed.

The push button air valve 43 is depressed thereby allowing air to be supplied from the regulator 2 to the pump 10. The pump 10 causes the fluid to be delivered to the vessel 1. Air is provided until the vessel 1 reaches a predetermined pressure below the desired proof pressure such as, for example 10 p.s.i. below the proof pressure. The pressure is indicated on the pressure gauge 210. The push button air valve 43 is then released. Alternatively, air can be supplied directly to the pump 10 from the regulator 2.

The precision adjustment unit 3*a*, as shown in FIG. 4, is then operated to bring the vessel 1 precisely to the desired proof pressure. The adjustment handle 200 is manually rotated thereby advancing the adjuster piston 184 towards the inward end of the cylinder 186. The advancement of the adjuster piston 184 reduces the volume occupied by the fluid resulting in increased pressure in the vessel 1. Should the pressure in the vessel 1 decay during the test, the adjustment handle 200 is turned gradually to compensate for the pressure loss. For example, the pump 10 coupled with the precision adjustment unit 3*a* has the precision to test vessels 1 according to the U.S. Department of Transportation regulations made effective Oct. 1, 1996, i.e., it must maintain the pressure within a fire extinguisher between 519–520 psi for a period of one minute or longer.

Once the test procedure has been completed, the vessel 1 is prepared for removal from the safety cage 4. First, the fluid inlet valve 206 is closed. Then the fluid outlet valve 208 is open ed to provide a passage for the fluid to drain from the vessel 1. Next, the safety cage 4 is rotated on the rod 238 about the horizontal axis 239 to an inverted position. Assist ed by gravity, the fluid drains from the vessel 1. The vessel cage 4 is then rotated back to the upright position. Thereafter, the coupler 224 is disconnected from the adapter 226 and the vessel 1 removed from the safety cage 4. The remaining components of the head assembly 222 are the n removed from the vessel 1.

The method of operation for the alternative embodiment shown in FIGS. 5 and 6, is substantially the same as previously described, except as described below.

Prior to air being supplied to the air motor module 12, the threaded member 254 is retracted so as to not interfere with the shaft 242 when the shaft 242 is reciprocating. Once the pressure in the vessel 1 has reached the predetermined pressure, the precision adjustment unit 3*b* is operated to bring the vessel 1 to the desired proof pressure. The adjustment knob 264 is manually rotated to advanced the thread ed member 254 until the socket 262 of the threaded member 254 engages the head 246 of the shaft 242. To finely adjust the pressure in the vessel 1, the threaded member 254 is further advanced so that the motor piston 24 is moved towards the first bulkhead 28. The movement of the motor piston 24 moves the pump piston 76 thereby forcing additional fluid into the vessel 1 and correspondly increasing the pressure in the vessel 1. Where there is insufficient travel between the motor piston 24 and the first bulkhead 28 to bring the vessel 1 to the desired proof pressure, the bleeder valve 241 is activated. By activating the bleeder valve 241, the cylinder 34 is vented on the second side of the motor piston 24 to cause the motor piston 24 to horizontally move towards the second bulkhead 30. Thereafter, sufficient travel is provided to advance the motor piston 24 towards the first bulkhead 28 as previously described.

Although particular embodiments of the invention have been described in detail, it will be understood that the invention is not limited correspondingly in scope, but includes all changes and modifications coming within the spirit and terms of the claims appended hereto.

What is claimed is:

1. A pressure test apparatus comprising:

a pump for delivering fluid to a test vessel; and a precision adjustment unit connected at an outlet side of said pump, said precision adjustment unit including a chamber and a piston assembly movably disposed in said chamber to vary the fluid volume of said chamber.

2. The apparatus of claim 1, further including a conduit having a first end connected to the outlet side of said pump and said precision adjustment unit connected at an intermediate position of said conduit.

3. A pressure test pump comprising:

a pump; and a precision adjustment unit connected at an outlet side of said pump, said precision adjustment unit including a chamber and a piston assembly movably disposed in said chamber to vary the fluid volume of said chamber, wherein said piston assembly comprises an adjuster piston, an adjustment bar having a proximal end and a distal end, said proximal end operably attached to said adjuster piston, a handle securely attached to said distal end, whereby said adjuster piston can be moved by rotating said handle.

4. A pressure test apparatus comprising:

an air-driven pump for delivering fluid to a test vessel, said air-driven pump including an air motor, a motor cylinder within said air motor, a motor piston within said motor cylinder, an air control system for supplying air from an air inlet to said motor cylinder alternately on each side of said motor piston while venting said motor cylinder on an opposite side of said motor piston to an air outlet to reciprocate said motor piston in said motor cylinder;

a fluid pump operably connected to said air motor including a pump cylinder, a pump piston within said pump cylinder and connected to said motor piston for reciprocable movement of said pump piston with said motor piston;

a precision adjustment unit connected at the air-driven pump, said precision adjustment unit including a chamber and a piston assembly movably disposed within said chamber to vary the fluid volume of said chamber.

5. The apparatus of claim 4, wherein said precision adjustment unit is connected at an outlet side of said fluid pump.

6. The apparatus of claim 5, further including a conduit having a first end connected to said outlet side of said fluid pump and said precision adjustment unit connected at an intermediate position of said conduit.

7. The apparatus of claim 4, wherein said piston assembly comprises an adjuster piston movably disposed in said chamber.

8. The apparatus of claim 7, wherein said piston assembly further comprises an adjustment bar having a proximal end and a distal end, said proximal end operably attached to said adjuster piston, a handle securely attached to said distal end, whereby said adjuster piston can be moved by rotating said handle.

9. The apparatus of claim 4, further comprising a manual air valve, said manual air valve connected to said air motor such that said air motor is supplied air only when said manual air valve is activated.

10. A pressure test apparatus comprising:

an air-driven pump including an air motor, a motor cylinder within said air motor, a motor piston within said motor cylinder, an air control system for supplying air from an air inlet to said motor cylinder alternately on a proximal and distal side of said motor piston while venting said motor cylinder on an opposite side of said motor piston to an air outlet to reciprocate said motor piston in said motor cylinder, a shaft having a proximal end and a distal end, said proximal end of said shaft connected to said motor piston and said distal end of said shaft extending external of said air motor;

a fluid pump operably connected to said-air motor, said fluid pump including a pump cylinder, a pump piston within said pump cylinder and removably connected to said motor piston for reciprocable movement of said pump piston with said motor piston; and a precision adjustment unit connected to said air motor, said precision adjustment unit including a threaded member having a proximal end removably connectable to said distal end of said shaft, wherein movement of said threaded member can impart movement to said shaft.

11. The apparatus of claim 10, further comprising a valve, said valve connected to said air motor to manually release air from said distal side of said cylinder when said valve is operated.

12. The apparatus of claim 11, further comprising a manual air valve, said manual air valve connected to said air motor such that said air motor is supplied air only when said manual air valve is activated.

13. The apparatus of claim 10, wherein said proximal end of said threaded member has a socket, and said distal end of said shaft has a head, said head sized to connectably fit within said socket.

14. A pressure test pump comprising:

a pump for delivering fluid to a test vessel under pressure; and a precision adjustment unit for finely adjusting the pressure of said fluid in said test vessel, said precision adjustment unit including:

a chamber containing a volume of said fluid;

a piston movably disposed in said chamber; and a shaft connected to said piston, said shaft having a handle for manually rotating said shaft for moving said piston in said chamber, and thereby varying the volume of said fluid in said chamber, wherein varying the volume of said chamber effectively varies the volume of said fluid in said test vessel thereby finely adjusting the pressure of said fluid in said test vessel.

15. A pressure test pump comprising:

a pump for delivering fluid to a test vessel under pressure, said fluid pump including a piston;

an air motor having a shaft for driving said piston; and a precision adjustment unit releasably connectable to said shaft for manually driving said piston to finely adjust the pressure of said fluid in said test vessel.

* * * * *

UNITED STATES PATENT AND TRADEMARK OFFICE

CERTIFICATE OF CORRECTION

PATENT NO. : 6,503,066 B1
DATED : January 7, 2003
INVENTOR(S) : George A. Cantley It is certified that error appears in the above-identified patent and that said Letters Patent is hereby corrected as shown below:

Title page,
Item [73], Assignee, please delete "Lynhurst", and enter therefor -- Lyndhurst --.

Drawings,
Please delete sheets 2, 3, 5 and 6, and insert therefor the attached new sheets 2, 3, 5 and 6.

Column 4,
Line 6, please delete "comers", and insert therefor -- corners --.

Column 11,
Line 57, please delete "the n", and insert therefor -- then --.

Column 12,
Line 1, please delete "thread ed", and insert therefor -- threaded --.

Signed and Sealed this

Sixteenth Day of December, 2003

JAMES E. ROGAN
*Director of the United States Patent and Trademark Office*